US008641587B2

(12) United States Patent
Hongo et al.

(10) Patent No.: US 8,641,587 B2
(45) Date of Patent: Feb. 4, 2014

(54) PROGRESSIVE RESISTANCE EXERCISE DEVICE

(71) Applicant: Triactive America, Inc., Grover Beach, CA (US)

(72) Inventors: Adrian K. Hongo, Grover Beach, CA (US); Brian K. Theiss, Simi Valley, CA (US)

(73) Assignee: Triactive America, Inc., Grover Beach, CA (US)

( * ) Notice: Subject to any disclaimer, the term of this patent is extended or adjusted under 35 U.S.C. 154(b) by 0 days.

(21) Appl. No.: 14/015,840

(22) Filed: Aug. 30, 2013

(65) Prior Publication Data

US 2014/0005016 A1 Jan. 2, 2014

Related U.S. Application Data

(62) Division of application No. 12/875,030, filed on Sep. 2, 2010, now Pat. No. 8,523,744.

(51) Int. Cl.
*A63G 21/00* (2006.01)

(52) U.S. Cl.
USPC ..... 482/131; 482/92; 482/95; 482/96

(58) Field of Classification Search
USPC ..... 482/92, 95–97, 131–133
See application file for complete search history.

(56) References Cited

U.S. PATENT DOCUMENTS 6,752,748 B1 * 6/2004 Scotti ..... 482/140
7,608,020 B2 * 10/2009 Mason ..... 482/97
7,717,832 B2 * 5/2010 Webber et al. ..... 482/100

* cited by examiner

*Primary Examiner* — Glenn Richman
(74) *Attorney, Agent, or Firm* — Fitch, Even, Tabin & Flannery LLP

(57) ABSTRACT

A device is provided that includes a post, an arm assembly being pivotably connected to the post at one or more connection points, a set of beams comprising an upper beam set and a lower beam set, wherein the upper beam set and the lower beam set each comprise one or more beams, the set of beams being pivotably connected to the post, wherein the post is connected to the upper beam set and the lower beam set such that the lower beam set and the upper beam set are positioned at a first distance apart from one another at their connection point with the post, a platform being pivotably connected to the set of beams, wherein the platform is connected to the upper beam set and the lower beam set such that the lower beam set and the upper beam set are positioned at a second distance apart from one another at their connection point with the platform and a lift tube having a length and being pivotably connected to the upper beam set at one or more connection points and the arm assembly at one or more connection points.

2 Claims, 7 Drawing Sheets

PROGRESSIVE RESISTANCE EXERCISE DEVICE

CROSS-REFERENCE TO RELATED APPLICATIONS

This application is a divisional of U.S. application Ser. No. 12/875,030 filed Sep. 2, 2010, which is incorporated in its entirety herein by reference.

BACKGROUND OF THE INVENTION

1. Field of the Invention

The present invention relates generally to exercise devices, and more specifically to a progressive resistance exercise device.

2. Discussion of the Related Art

Weight lifting and weight training exercises are widely used to build strength, to prevent injury and to improve overall health. Such exercises are typically performed with exercise devices and/or free weights. Most exercise devices are designed having weights attached thereon and allow the user to adjust the weight for their exercise using the attached weights. Each device generally allows for a different movement and focuses on either an upper body or lower body exercise or movement. Further, the attached or free weights provide for the resistance to achieve the above goals.

These devices are limited to focusing on either upper body or lower body workout. Furthermore, the use of weights, attached to the device or free weights, provide a static source of resistance, i.e. a 50 pound weight plate will provide the same 50 pounds of force over the range of the movement. This can be termed "constant resistance".

SUMMARY OF THE INVENTION

In one embodiment, the invention can be characterized as a device comprising a post, an arm assembly being pivotably connected to the post at one or more connection points, a set of beams comprising an upper beam set and a lower beam set, wherein the upper beam set and the lower beam set each comprise one or more beams, the set of beams being pivotably connected to the post, wherein the post is connected to the upper beam set and the lower beam set such that the lower beam set and the upper beam set are positioned at a first distance apart from one another at their connection point with the post, a platform being pivotably connected to the set of beams, wherein the platform is connected to the upper beam set and the lower beam set such that the lower beam set and the upper beam set are positioned at a second distance apart from one another at their connection point with the platform and a lift tube having a length and being pivotably connected to the upper beam set at one or more connection points and the arm assembly at one or more connection points.

In another embodiment, the invention can be characterized as a method comprising providing a post, providing an arm assembly being and pivotably connecting the post and the arm assembly at one or more connection points, providing a set of beams comprising an upper beam set and a lower beam set, wherein the upper beam set and the lower beam set each comprise one or more beams, pivotably connecting the set of beams to the post, wherein the post is connected to the upper beam set and the lower beam set such that the lower beam set and the upper beam set are positioned at a first distance apart from one another at their connection point with the post, pivotably connecting a platform to the set of beams, wherein the platform is connected to the upper beam set and the lower beam set such that the lower beam set and the upper beam set are positioned at a second distance apart from one another at their connection point with the platform and providing a lift tube having a length and pivotably connecting the lift tube to the upper beam set at one or more connection points and the arm assembly at one or more connection points.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
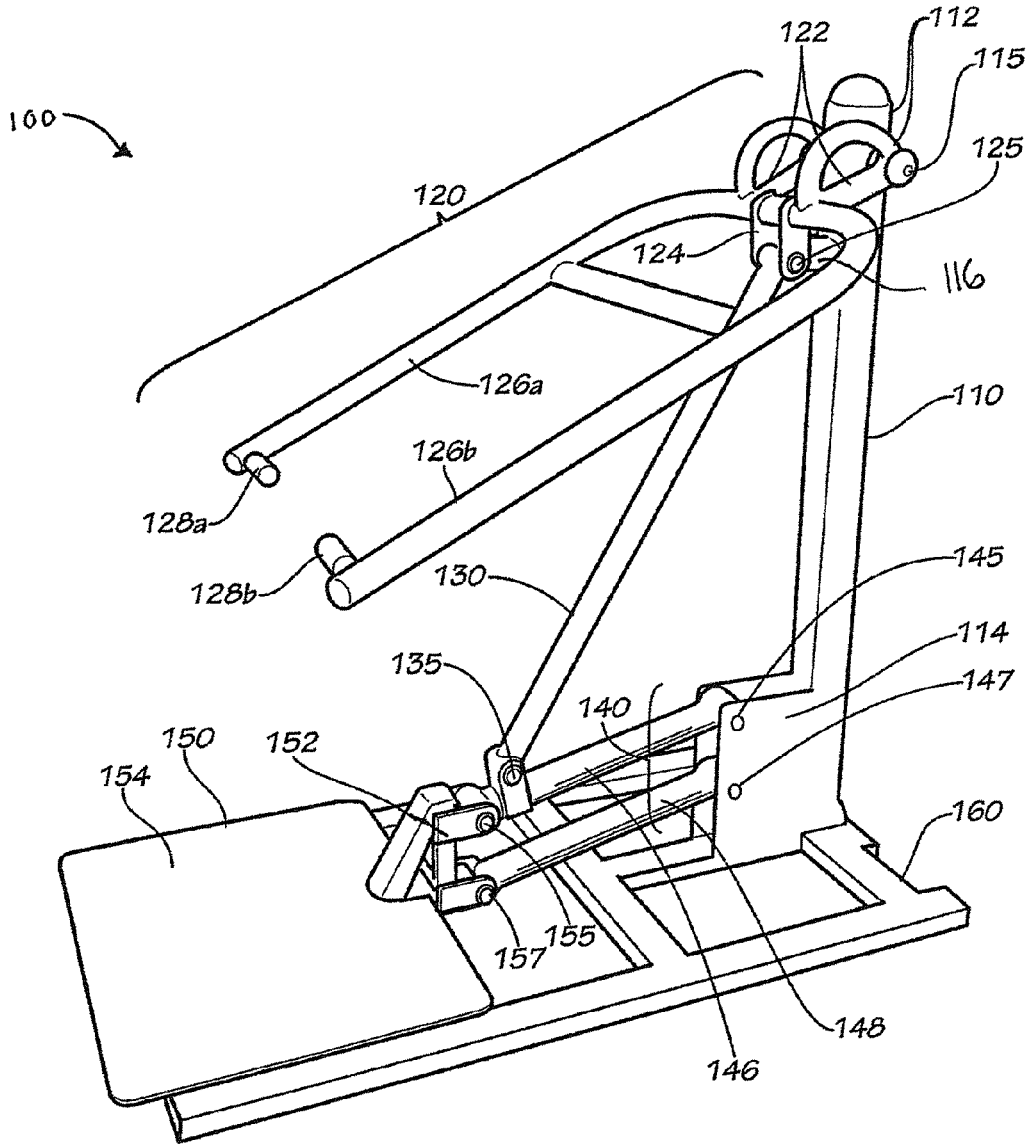
FIG. 1 illustrates a Squat Press device according to several embodiments of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Throughout the specification one or more exercise devices are described from a side view. Reference to an element is made with respect to the side viewable on the figures. It should be understood that both side views of these devices mirror one another about a plane. Therefore, while the elements are described with respect to one view, the description extends to the entire device. Where specific description is provided with respect to both the right side and left side element, the element number is stated with a small case a, denoting left side, or b, denoting right side.

The squat is a popular strength training movement that develops strength in the lower body. The user starts from a squatted position where the hips and knees are bent and feet spread a little wider than shoulder-width. The exercise consists of the movement from the starting squatted position, and then by extending the lower limbs rises up into the standing position. Typically, weight held at the shoulders, usually either implemented by free weights or by attached weights at an exercise device, is combined with the user's body weight to form the resistive force the muscles must overcome while pushing up into the standing position. In performing this movement against resistance, the user can develop muscular strength thru frequent training. As described above different devices or free weights can be used to perform the squat using weights to provide resistance for the user. Other machines provide for the user's shoulders to be held stationary, and the weight/resistance to be felt on the feet and legs.

As a more intense training exercise, the squat movement, a lower body exercise, may be combined with an upper body exercise in one continuous movement to increase the level of exertion for the body and thus increase the effectiveness of the workout. Several different upper body workouts may be combined with the squat movement in one or more embodiments. For example, in some embodiments, the user may, while performing a squat into the standing position, simultaneously push upward using the shoulders and triceps to an above the head position. This upper body movement can be called a shoulder or military press. Therefore, the squat movement may be combined with a shoulder press to allow both lower body and upper body strength gains (referenced herein as a "Squat Press"). In another embodiment, while performing a squat into the standing position, the user may simultaneously pull forward using the arms and back. This upper body movement may be referred to as a row. A row is a pull-type, compound exercise which works primarily the middle back, but also works the Latissimus and arms. In one or more embodiments, the squat movement may be combined with a row to allow both lower body and upper body strength gains (referenced herein as a "Squat Row"). In yet another embodiment, while performing a squat into the standing position, the user may simultaneously pull up or curl up using the biceps to perform a bicep curl.

The present invention provides an exercise device that allows the combination of lower body strengthening, e.g. squat movement, and upper body strengthening, e.g., arm, shoulder or back exercises such as the shoulder or tricep press, row, or curl, in a device that is mechanically levered to the user to utilize only body weight for the resistance, thus providing a "progressive resistance". That is, as the user moves through the range of motion, the resistance increases. In exercise training principles, it has been shown that exercise using progressive resistance provides more efficient strength gains, in comparison to static resistance resulting from the use of most free weight devices.

In several different embodiments, different upper body exercises may be combined with the lower body squat movement.

Referring to FIG. 1, a Squat Press device 100 is illustrated according to several embodiments of the present invention.

As illustrated the Squat Press device 100 comprises a post 110, an arm assembly 120, a lift tube 130, a set of beams 140, a platform 150 and a base 160.

The post 110 provides the supporting structure for the Squat Press device 100. In one embodiment, the post 110 comprises two connector portions 112, and 116 for connection to the driving elements of the squat press, i.e. the arm assembly 120, the lift tube 130 and the beams 140. A first connector portion 112 approximately near the top of the post connects to a connector portion 122 of the arm assembly at a connection point 115. In one embodiment through a second connector portion 114 the post 110 is connected to the set of beams 140. In several embodiments, the set of beams 140 comprise an upper beam 146 and a lower beam 148. In one embodiment, the post 110 is joined with the set of beams 140, at a connection point 145 connecting to the upper beam 146, and at connection point 147 connecting to the lower beam 148. In one or more embodiments, the post 110 may further comprise a bumper 116 to prevent the assembly 120 from unnecessary contact with the post.

In one or more embodiments, the arm assembly 120 comprises a connector section 124 which provides connection to the lift tube 130 at a connection point 125. The arm assembly 120 comprises a left lever **126*a* and right lever 126*b*. In some embodiments, each of the left lever 126*a* and right lever 126*b* comprises a handle 128*a* and 128*b* respectively at their end farthest from the post. In one or more embodiments, the handles 128*a* and 128*b* and/or the arm assembly 126*a* and 126*b*** may comprise one or more of handle grips, shoulder pads, and other similar elements.

In one embodiment, the user of the Squat Press device 100 drives the Squat Press device by grabbing the handles **128*a* and 128*b* and moving the arm assembly 120** upward. In one embodiment, the arm assembly, upon being pushed upward by the user travels an upward arc.

The lift tube 130 provides connection between the arm assembly 120 and the beams 140 and, through the beams 140, to the platform 150. In one embodiment, the lift tube 130 provides the means for driving the Squat Press device by transferring the movement of the arm assembly 120 by the user to the beams 140 to cause the upward movement of the platform 150 and thus the user, to provide the resistance necessary for achieving the strength training objectives of the Squat Press.

In one embodiment, the upper end of the lift tube is connected with the arm assembly at a connection point 125 as stated above. In one or more embodiments, the lift tube 130 also connects to the upper beam 146 at a connection point 135. Through the connection to the arm assembly 120 and the beam 140, the lift tube 130 translates the movement of the arm assembly to cause the beams 140 to move such that the platform 150 is displaced upward, thus implementing a resistance through the body weight of the user.

The set of beams 140 comprise an upper beam 146 and lower beam 148. In one or more embodiments, the upper beam set 146 and lower beam set 148 are placed such that they remain parallel to one another through the range of motion of the device 100. In one embodiment, this is achieved through equal distance between connection points 145 and 147 and connection points 155 and 157. In some embodiments, the beams 140 are placed such that they ensure the upward movement of the platform 150 in an upright position without allowing the platform 150 to tilt. In an alternative embodiment, a certain tilt angle may be desirable and may be achieved by a different placement of the beams 140 and/or one or more of the connector portions or connection points 135, 142, 145, 147, 152, 155 and 157 In one or more additional or alternative embodiments, other connection points, connector portions or elements of the exercise device may also additionally or alternatively be modified to achieve the desired tilt or modified movement of the platform.

The beams 140 are connected to the platform 150 at the connector portion 152 of the platform 150 through connection point 155 connecting the upper beam set 146 to the connector portion 152. The placement of the beams including the length of the beams 146 and 148, the distance between the beams 146 and 148, and the distance between connection points 145 and 147 and connection points 155 and 157 are calculated to achieve one or more of a straight movement of the platform parallel to the base 160, a certain amount of resistance with respect to the movement, and a range of movement of the platform 150 in relation to the movement of the arm assembly.

The platform 150 receives the feet of the user and provides a standing position for the user. In an alternative embodiment, the platform may receive the user in a seated position. In one or more embodiments the platform 150 is designed having one or more standing pads. In one embodiment, the platform comprises the flat plate 154 as shown. In some embodiments, additionally or alternatively the platform 150 may further comprise an incline plate for receiving the user's feet to provide for a modified exercise.

The base 160 provides a standing support structure for the exercise device 100. In one or more embodiments, the base 160 is self supporting. That is, no other installation features are necessary, though they help secure the piece to the ground. In one or more embodiments, base 160 is provides for the entire unit and unit function without the need for any extra installation features.

In one or more embodiments, the base 160 is connected the rest of the device by its connection to the post 110. In one embodiment, the post and base are joined by being welded to one another to provide stability. In another embodiment, the base and post might be removably connected to achieve mobility.

In one or more embodiments, the device 100 is designed such that it is fit for both inside and outside use. In one or more embodiments for example the device is built to be robust to withstand outside conditions such as rain, sunshine, wind or other external factors. In one or more embodiments, the machine is implemented by materials that are fit for both inside and outside use and provide for improved weatherability. In one embodiment, a coating may be applied to one or more portions of the device to provide for improved withstanding of various environmental conditions. In other embodiments, the device may comprise wheels and/or other means to allow for mobility of the device.

In one embodiment, to use device 100, the user stands on the flat plate 154 of the platform 150, and engages the handles 128*a* and 128*b*. In one or more embodiments, the user starts at a starting squat position with the levers 126*a* and 126*b* above his shoulder and his knees bent. Upon the user's upward movement, the handles and plate move in an upward direction around the connection points of the frame comprising the post 110 and base 160. When the user moves the handles upward in performing a squat, the connections engage the plate which also begins to move upward. The range of motion of the Squat Press allows the user to perform a squat, and then continue upward with the handles into a shoulder press. In one or more embodiments, based on the mechanical connection points and the device's range of motion, as the user increases the range of motion, the plate continues to rise and the resistance felt at the handles increases due to the mechanical leverage. In some embodiments, this provides a progressive resistance until the user lowers the handles towards the start position. In one or more embodiments, while performing the exercise the user will be facing the post. In one or more embodiments, the distance traveled by the platform is a fraction of the distance traveled by the arm assembly.

In some embodiments, additional weights may be added to the device to further increase the resistance. For example, in one embodiment pegs may be implemented for adding free weights to increase overall resistance. In other embodiments, resistance may be varied by implementing a rack/pin system or pin system for adjusting lever position and thus the resistance and handle positions.

Figure 2:
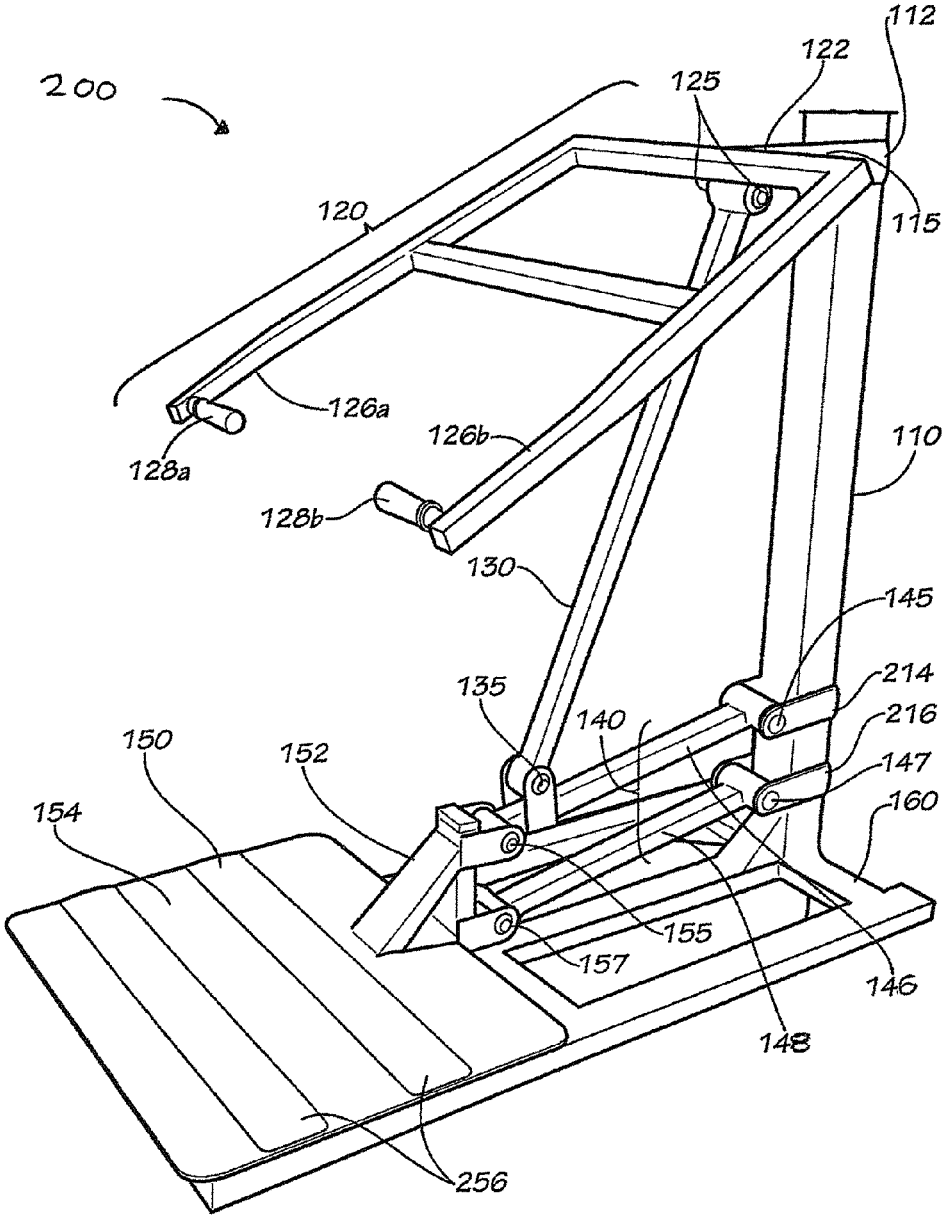
FIG. 2 illustrates a second embodiment of the Squat Press device according to an alternative embodiment of the present invention.

Referring next to FIG. 2, a second embodiment of the Squat Press device 100 is illustrated as device 200, according to an alternative embodiment of the present invention.

Several elements of the Squat Press device 200 are similar to those described above with respect to the device 100 and have been labeled similar to those of the device 100. The differences between the alternative embodiments will be described herein.

In the illustrated embodiment of the device 200, the post 110 comprises three connector portions 112, 214 and 216 for connection to the arm assembly 120 and the beams 140. A first connector portion 112 approximately near the top of the post connects to a connector portion 122 of the arm assembly at a connection point 115.

In one embodiment, as shown in FIG. 2, a two part connector having a top connector portion 214 and a bottom connector portion 216 is provided for connecting the base to the beams 146 and 148 respectively. In one embodiment, the post 110 is joined with the upper set of beams 146, at connection point 145, through the connector portion 214, and at connection point 147, connecting to the lower beam 148, through the connector portion 216.

The platform 150 of FIG. 2 is similar to that of FIG. 1. In this embodiment the platform 150 comprises standing pads 256 on the flat plate 154 of the flat plate.

Figure 3:
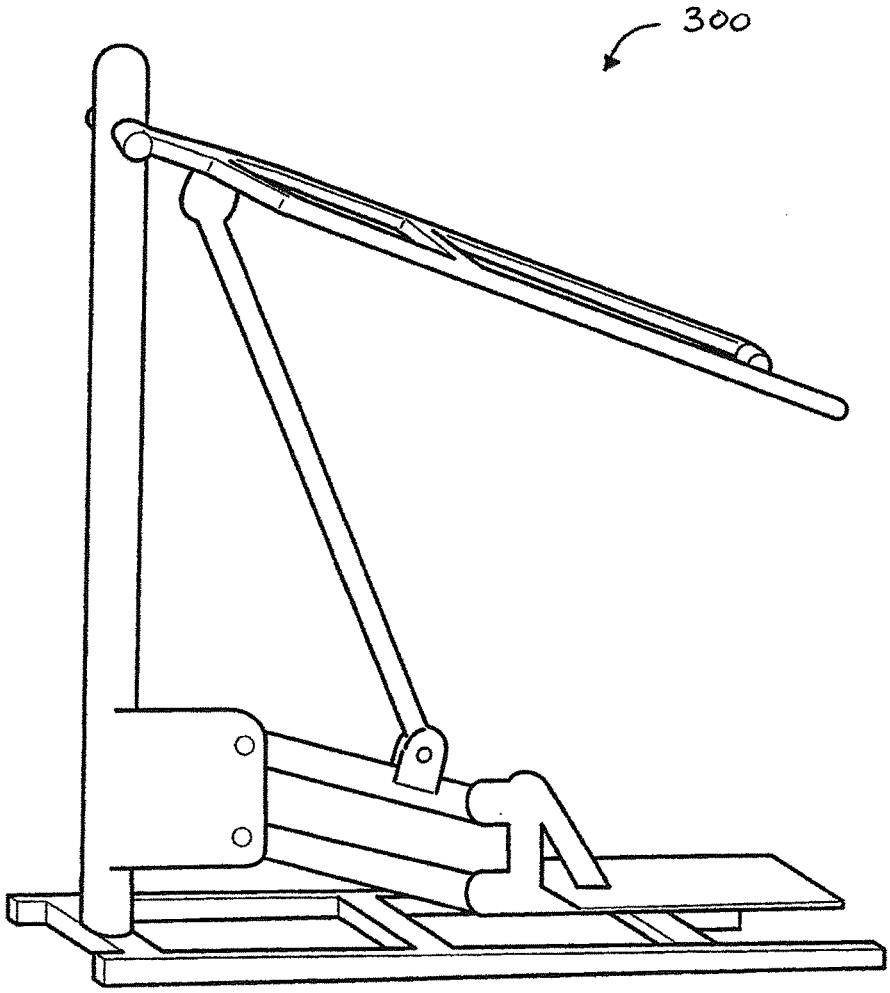
FIG. 3 illustrates a third embodiment of the Squat Press device according to one or more embodiments of the present invention.

FIG. 3 illustrates yet another embodiment of the Squat Press device 100 according to one or more embodiments of the present invention. The squat device of FIG. 3 is similar to that of FIG. 2 except for in design. More specifically as shown, the design of the arm assembly 120 is different than that of Squat Press device 200 of FIG. 2.

Figure 4:
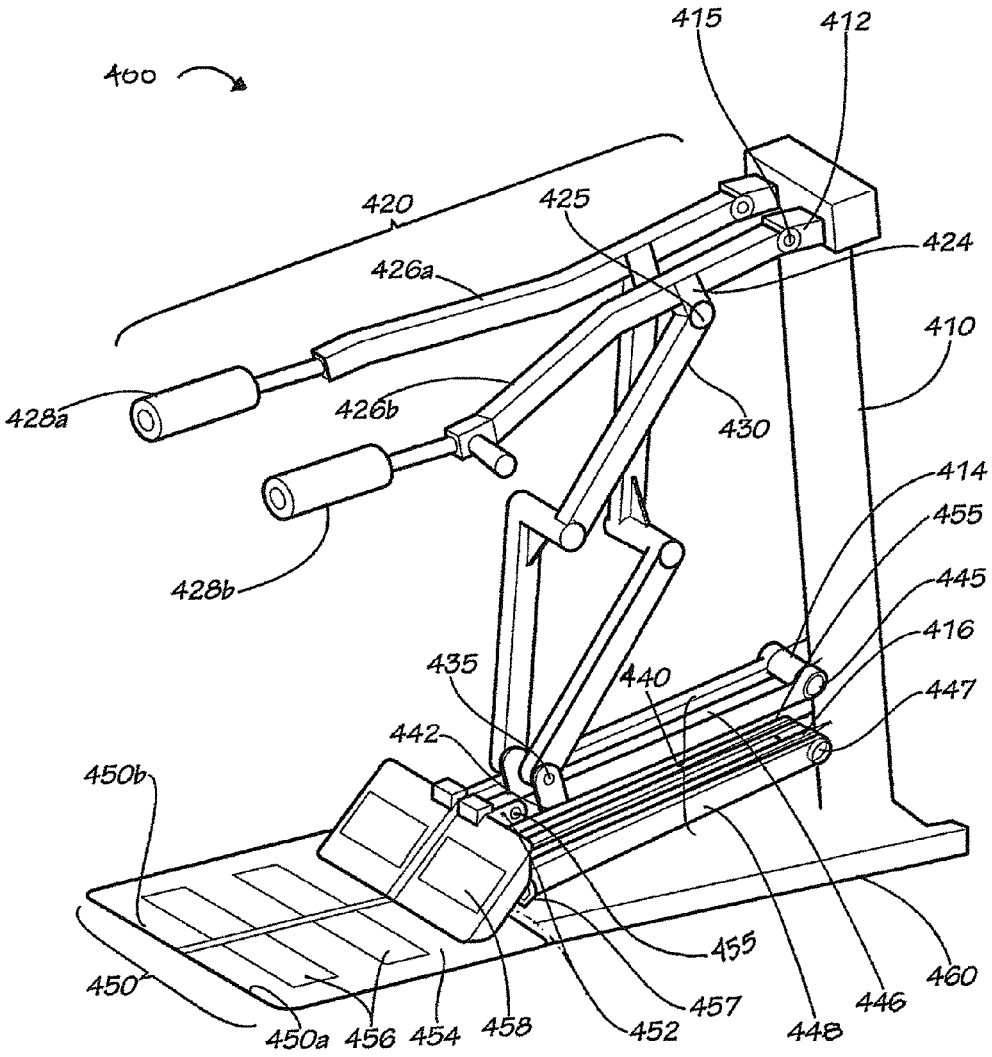
FIG. 4 illustrates a bilateral Squat Press device according to several embodiments of the present invention.

Next referring to FIG. 4, a bilateral Squat Press device 400 is illustrated according to several embodiments of the present invention.

In several embodiments, a modified Squat Press movement is performed using the bilateral Squat Press device 400. In one or more embodiments, this modified movement may provide a more effective strength training exercise.

As illustrated the Squat Press device 400 comprises a post 410, an arm assembly 420, a lift tube 430, a set of beams 440, a platform 450 and a base 460. In one or more additional or alternative embodiments, the device may comprise other elements, such as handle grips, shoulder pads, and other optional features.

The post 410 provides the supporting structure for the bilateral Squat Press device 400. In one embodiment, the post 410 comprises three connector portions 412, 414 and 416 for connection to the min assembly 420 and the beams 440. A first connector portion 412 approximately near the top of the post 410 connects to the arm assembly 420 at connection point 415. The second connector portion 414 and third connector portion 416 of the post 410 are connected to the set of beams 440. In several embodiments, the set of beams 440 comprise an upper beam set 446 and a lower beam set 448. In one embodiment, the post 410 is joined with the set of beams 440, at connection points 445, connecting to an end of the upper beam set 446, and at connection point 447, connecting to the lower beam set 448.

The arm assembly 420 comprises a left lever 426*a* and right lever 426*b*. In some embodiments, each of the left lever 426*a* and right lever 426*b* comprises a handle 428*a* and 428*b* respectively at their end farthest from the post. In one or more embodiments, the handles 428*a* and 428*b* and/or the arm assembly 426*a* and 426*b* may comprise one or more of handle grips, shoulder pads, and other similar elements. In one embodiment, the user of the Squat Press device 400 drives the Squat Press by grabbing one or both the handles 428*a* and 428*b* and moving the arm assembly 420 upward. In one embodiment, the arm assembly, upon being pushed upward by the user travels an upward arc. Connector portion 424 extending from lever 426 provides a connection between the arm assembly 420 and the lift tube 430 at the connection point 425.

The lift tube 430 provides connection between the arm assembly 420 and the beams 440 and the platform 450. In one embodiment, the lift tube 430 provides the means for driving the bilateral Squat Press device 400 by transferring the movement of the arm assembly 420 by the user to the beams 440 to cause the upward movement of the platform 450 and thus the user, to provide the resistance necessary for achieving the strength training objectives of the Squat Press.

The lift tube comprises two tubes 430*a* and 430*b*. For each of the lift tubes 430*a* and 430*b*, of the lift tube is connected with the arm assembly at a connection point 425 as sated above. In one or more embodiments, the other end of the lift tube connects to a connector portion 442 extending from the upper beam 446 at a connection point 435. Through the connection to the arm assembly 420 and the upper beam set 446, the lift tubes 430 translate the movement of the arm assembly to cause the beams 440 to move such that the platform 450 is displaced upward, thus implementing a resistance through the body weight of the user. According to the illustrated embodiment, the lift tube 430*a* connects the left lever 426*a* of the arm assembly 420 and to the right upper beam 446*b* which in turn connects to the right platform 450*b*. Similarly the lift tube 430*b* connects the right lever 426*b* of the arm assembly 420 and to the left upper beam 446*a* which in turn connects to the left platform 450*a*.

The set of beams 440 comprise an upper beam set 446 and lower beam set 448. In one or more embodiments, the upper beam set 446 and lower beam set 448 are placed such that they remain parallel to one another through the range of motion of the device 400. In one embodiment, this is achieved through equal distance between connection points 445 and 447 and connection points 455 and 457. In some embodiments, the beams 440 are placed such that they ensure the upward movement of the platform 450 in an upright position without allowing the platform 450 to tilt. In an alternative embodiment, a certain tilt angle may be desirable and may be achieved by a different placement of the beams 440 and/or one or more of the connector portions or connection points 435, 442, 445, 447, 452, 455 and 457 In one or more additional or alternative embodiments, other connection points, connector portions or elements of the exercise device may also additionally or alternatively be modified to achieve the desired tilt or modified movement of the platform. The beams 440 are connected to the platform 450 at connector portion 452 of the platform 450 through connection points 455 and 457 each connecting one of the upper beam set 446 and lower beam set 448 to the connector portions 452. The placement of the beams including the length of the beams 440, the distance between the upper beams 446 and lower beams 448 and the distance between connection points 445 and 447 and connection points 455 and 457 are calculated to achieve one or more of a straight movement of the platform parallel to the base 460, a certain amount of resistance with respect to the movement, and a range of movement of the platform 450 in relation to the movement of the arm assembly.

The platform 450 comprises a left platform 450*a* and a right platform 450*b*, each connecting to the beams 440 through the connectors 452*a* and 452*b* respectively. The left platform 450*a* receives the left foot of the user and the right platform 450*b* receives the right foot of the user thus providing a standing position for the user. In one or more embodiments the platform 450 is designed having one or more standing pads 456. In one embodiment, the platforms 450*a* and 450*b* each comprises a flat plate 454. In some embodiments, additionally or alternatively the platforms 450*a* and 450*b* further comprise an incline plate 458 for receiving the user's feet to provide for a modified exercise.

The base 460 provides a standing support structure for the Squat Press device 100. In one or more embodiments, the base 460 is connected the rest of the device by its connection to the post 410. In one embodiment, the post and base are joined by being welded to one another to provide stability. In another embodiment, the base and post might be removably connected to achieve mobility.

In one or more embodiments, the device 400 is designed such that it is fit for both inside and outside use. In one or more embodiments for example the device is built to be robust to withstand outside conditions such as rain, sunshine, wind or other external factors. In other embodiments, the device may comprise wheels and/or other means to allow for mobility of the device.

In one embodiment, to use device 400, the user stands on either the flat plates 454 or the inclines 458 of the platform 450, and engages the handles 428. In one or more embodiments, the user starts at a starting squat position with the levers 426*a* and 426*b* above his shoulder and his knees bent. Upon the user's upward movement, the handles and plate move in upward arc paths around the connection points at the frame comprising the post 410 and base 460. The modified exercise occurs when the user engages one leg in the Squat, and simultaneously engages the opposite-side arm for the Press. For example, the device would allow the user to stand on the right leg on plate 454*b*, and while grasping the left handle 428*a*, push upward with the right leg while extending upward with the left arm. The device 400 is connected in a way that allows this opposite-side movement, and can switch from one side to the other. It should be apparent that the previously described Squat Press movement with respect to devices 100-300 is also achievable, if pushing with both legs and both arms. Regardless of whether the user is performing a Squat Press or a modified Squat Press, when the user moves the handles upward in performing a squat, the connections engage the plate which also begins to move upward. The range of motion of the Squat Press allows the user to perform a squat, and then continue upward with the handles into a shoulder press. In one or more embodiments, based on the mechanical connection points and the device's range of motion, as the user increases the range of motion, the plates continues to rise and the resistance felt at the handles increases due to the mechanical leverage. In some embodiments, this provides a progressive resistance until the user lowers the handles towards the start position. In one or more embodiments, while performing the exercise the user will be facing the post. In one or more embodiments, the distance traveled by the platform is a fraction of the distance traveled by the arm assembly.

In some embodiments, additional weights may be added to the device to further increase the resistance. For example, in one embodiment pegs may be implemented for adding free weights to increase overall resistance. In other embodiments, resistance may be varied by implementing a rack/pin system or pin system for adjusting lever position and thus the resistance and handle positions.

Figure 5:
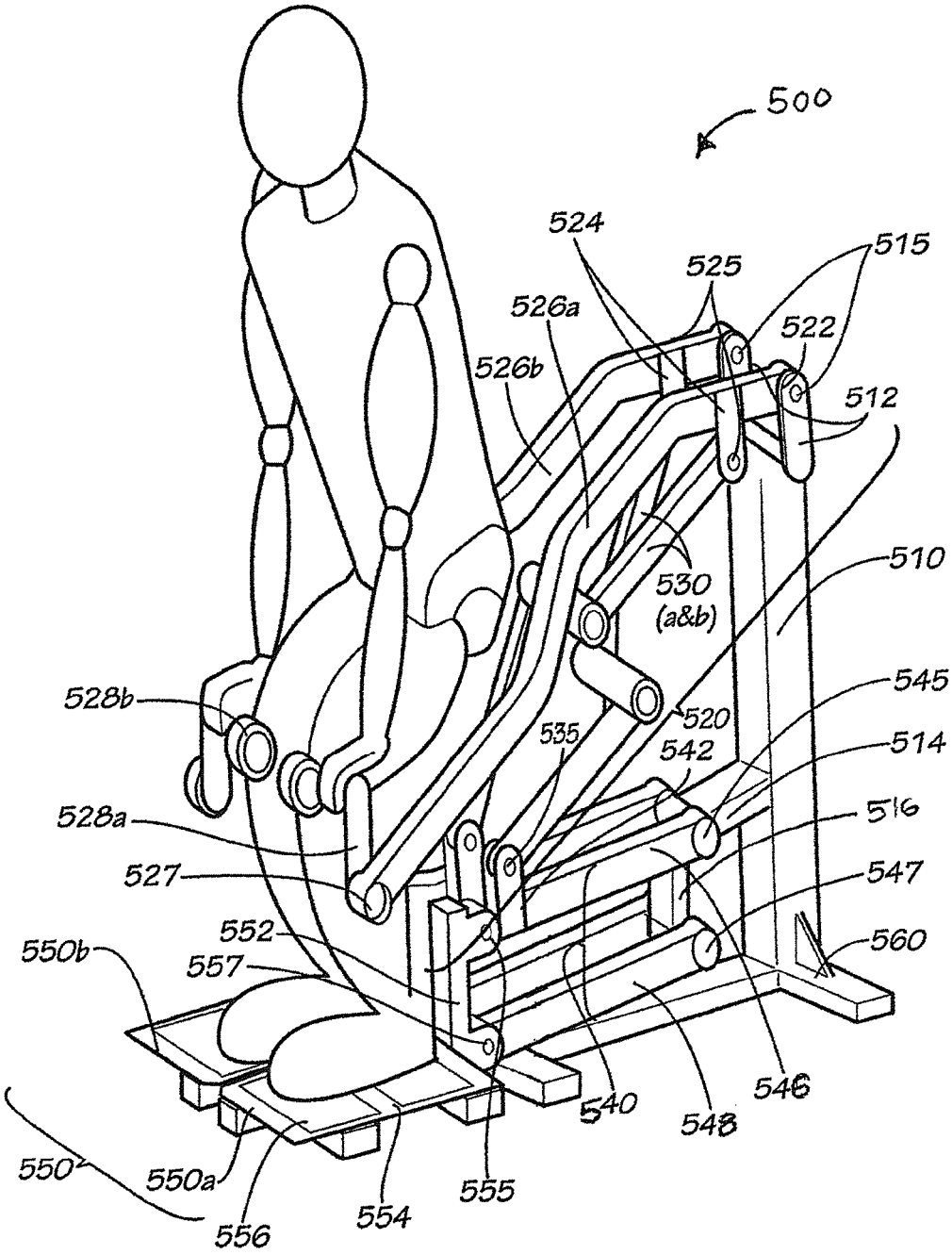
FIG. 5 illustrates a Squat Curl device according to one or more embodiments of the present invention.

Next referring to FIG. 5, a Squat Curl device 500 is illustrated according to one or more embodiments of the present invention.

According to one or more embodiments, Squat Curl device 500 comprises a post 510, an arm assembly 520, a lift tube 530, a set of beams 540, a platform 550 and a base 560. The device 500 illustrated and described herein comprises a bilateral implementation of the Squat Curl device, however, as with the Squat Press, different embodiments may be implemented by a simple combination of one or more elements of the device 500.

According to one or more embodiments, the post 510 provides the supporting structure for the bilateral Squat Curl device 500. In one embodiment, the post 510 comprises three connector portions 512, 514 for connection to the arm assembly 520 and the beams 540. A first connector portion 512 of the post 510 connects to connector portion 522 of the arm assembly at connection point 515. The second connector portions 514 of the post 510 and third connector portions 516 provide connection to the set of beams 540. In one embodiment, the third connector portion 516 may be attached to the base 560. In several embodiments, the set of beams 540 comprise an upper beam set 546 and a lower beam set 548. In one embodiment, the post 510 is joined with the set of beams 540, at connection points 545, connecting to an end of the upper beam set 546 closest to the post, and at connection points 547, connecting to an end of the lower beam set 548 closest to the beam.

The arm assembly 520 comprises a left lever 526*a* and right lever 526*b*. In some embodiments, each of the left lever 526*a* and right lever 526*b* comprises a handle 528*a* and 528*b* respectively at their end farthest from the post 510. In one or more embodiments, the handles 528*a* and 528*b* and/or the arm assembly 526*a* and 526*b* may comprise one or more of handle grips, shoulder pads, and other similar elements. In one embodiment, the user of the Squat Curl device 500 drives the device by grabbing one or both the handles 528*a* and 528*b* and moving the arm assembly 520 upward. In one embodiment, the arm assembly 520, upon being pushed upward by the user travels an upward arc. Connector section 524 extending from lever 526 provides a connection between the arm assembly 520, and more specifically levers 526*a* and 526*b*, and the lift tubes 530*a* and 530*b* at the connection points 525*a* and 525*b* respectively.

The lift tubes 530 provide connection between the arm assembly 520 and the beams 540 and through the beams to the platform 550. In one embodiment, the lift tube 530 provide the means for driving the bilateral Squat Curl device 500 by transferring the movement of the arm assembly 520 by the user to the beams 540 to cause the upward movement of the platform 550 and thus the user, to provide the resistance necessary for achieving the strength training objectives of the Squat Press.

The lift tube comprises two tubes 530*a* and 530*b*. For each of the lift tubes 530*a* and 530*b*, an upper portion of the lift tube is connected with the arm assembly at a connection point 525*a* or 525*b* as stated above. In one or more embodiments, the other end of each of the lift tubes 530*a* and 530*b* connects to a connector portion 542*a* or 542*b* extending from the upper beams 546 at a connection point 545*a* or 545*b*. Through the connection to the arm assembly 520 and the upper beam set 546, the lift tube 530 translates the movement of one or both of the levers 526*a* and 526*b* of the arm assembly 520 to cause one or both of the right or left sets of the beams 540 to move such that the platform 550 or a right or left portion thereof is displaced upward, thus implementing a resistance through the body weight of the user. According to the illustrated embodiment, the lift tube 530*a* connects the left lever 526*a* of the arm assembly 520 to the right upper beam 546*b* which in turn connects to the right platform 550*b*. Similarly the lift tube 530*b* connects the right lever 526*b* of the arm assembly 520 to the left upper beam 546*a* which in turn connects to the left platform 550*a*.

The set of beams 540 comprise an upper beam set 546 and lower beam set 548. In one or more embodiments, the upper beam set 546 and lower beam set 548 are placed such that they remain parallel to one another through the range of motion of the device 500. In one embodiment, this is achieved through equal distance between connection points 545 and 547 and connection points 555 and 557. In some embodiments, the beams 540 are placed such that they ensure the upward movement of the platform 550 in an upright position without allowing the platform 550 to tilt. In an alternative embodiment, a certain tilt angle may be desirable and may be achieved by a different placement of the beams 540 and/or one or more of the connector portions or connection points 535, 542, 545, 547, 552, 555 and 557 In one or more additional or alternative embodiments, other connection points, connector portions or elements of the exercise device may also additionally or alternatively be modified to achieve the desired tilt or modified movement of the platform. The beams 540 are connected to the platform 550 through the connector portion 552 of the platform 550 through connection point 555 and 557 each connecting one of the upper beam set 546 and lower beam set 548 to the connector portion 552. The placement of the beams including the length of the beams 540, the distance between the upper beams 546 and lower beams 548 and the distance between connection points 545 and 547 and connection points 555 and 557 are calculated to achieve one or more of a straight movement of the platform parallel to the base 560, a tilt angle in the platform with respect to the base, a certain amount of resistance with respect to the movement, and a range of movement of the platform 550 in relation to the movement of the arm assembly.

In one or more embodiments, the platform 550 comprises a left platform 550*a* and a right platform 550*b*, each connecting to the beams 540 through the connectors 552*a* and 552*b* respectively. The left platform 550*a* receives the left foot of the user and the right platform 550*b* receives the right foot of the user thus providing a standing position for the user. In one or more embodiments the platform 550 is designed having one or more standing pads 556. In one embodiment, the platforms 550*a* and 550*b* each comprises a flat plate 554 as shown. In some embodiments, additionally or alternatively, the platforms 550*a* and 550*b* further comprise an incline plate for receiving the user's feet to provide for a modified exercise.

The base 560 provides a standing support structure for the exercise device 500. In one or more embodiments, the base 560 is connected to the rest of the device by its connection to the post 510. In one embodiment, the post and base are joined by being welded to one another to provide stability. In another embodiment, the base and post might be removably connected to achieve mobility.

It will be apparent that in an alternative embodiment by combining the arm assembly 520*a* and 520*b*, the lift tube 530*a* and 530*b* and the platform 550*a* and 550*b* into singular elements 520, 530 and 550 similar to the Device 100-300, a modified device may be achieved.

In one or more embodiments, the device 500 is designed such that it is fit for both inside and outside use. In one or more embodiments for example the device is built to be robust to withstand outside conditions such as rain, sunshine, wind or other external factors. In other embodiments, the device may comprise wheels and/or other means to allow for mobility of the device.

In one embodiment, to use device 500, the user stands on either one or both the plates 554*a* and 554*b* or one or both the optional inclines of the platform 550, and engages one or both of the handles 528*a* and 528*b*. In one or more embodiments, the user starts at a starting squat position with the levers 526*a* and 526*b* approximately in line with the knees and or below the waist while the knees are bent. Upon the users upward movement, the handles and plate move in upward arc paths around the connection points at the frame comprising the post 510 and base 560 until the levers reach a position at the chest and user is at a standing position. The modified exercise occurs when the user engages one leg in the Squat, and simultaneously engages the opposite-side arm for the Curl. For example, the device would allow the user to stand on the right leg on plate 554*b*, and while grasping the left handle 528*a*, push upward with the right leg while extending upward with the left arm. The device 500 is connected in a way that allows this opposite-side movement, and can switch from one side to the other. It should be apparent that the previously described two handed Squat Curl movement is also achievable with both legs and both arms. Regardless of whether the user is performing a one handed Squat Curl or a two handed Squat Curl, when the user moves the handles upward in performing a squat, the connections engage the plate which also begins to move upward. The range of motion of the Squat Curl allows the user to perform a squat, and then continue upward with the handles into a bicep curl. In one or more embodiments, based on the mechanical connection points and the device's range of motion, as the user increases the range of motion, the plates continues to rise and the resistance felt at the handles increases due to the mechanical leverage. In some embodiments, this provides a progressive resistance until the user lowers the handles towards the start position. In one or more embodiments, while performing the exercise the user will be facing away from the post. In one or more embodiments, the distance traveled by the platform is a fraction of the distance traveled by the arm assembly.

In some embodiments, additional weights may be added to the device to further increase the resistance. For example, in one embodiment pegs may be implemented for adding free weights to increase overall resistance. In other embodiments, resistance may be varied by implementing a rack/pin system or pin system for adjusting lever position and thus the resistance and handle positions.

Figure 6:
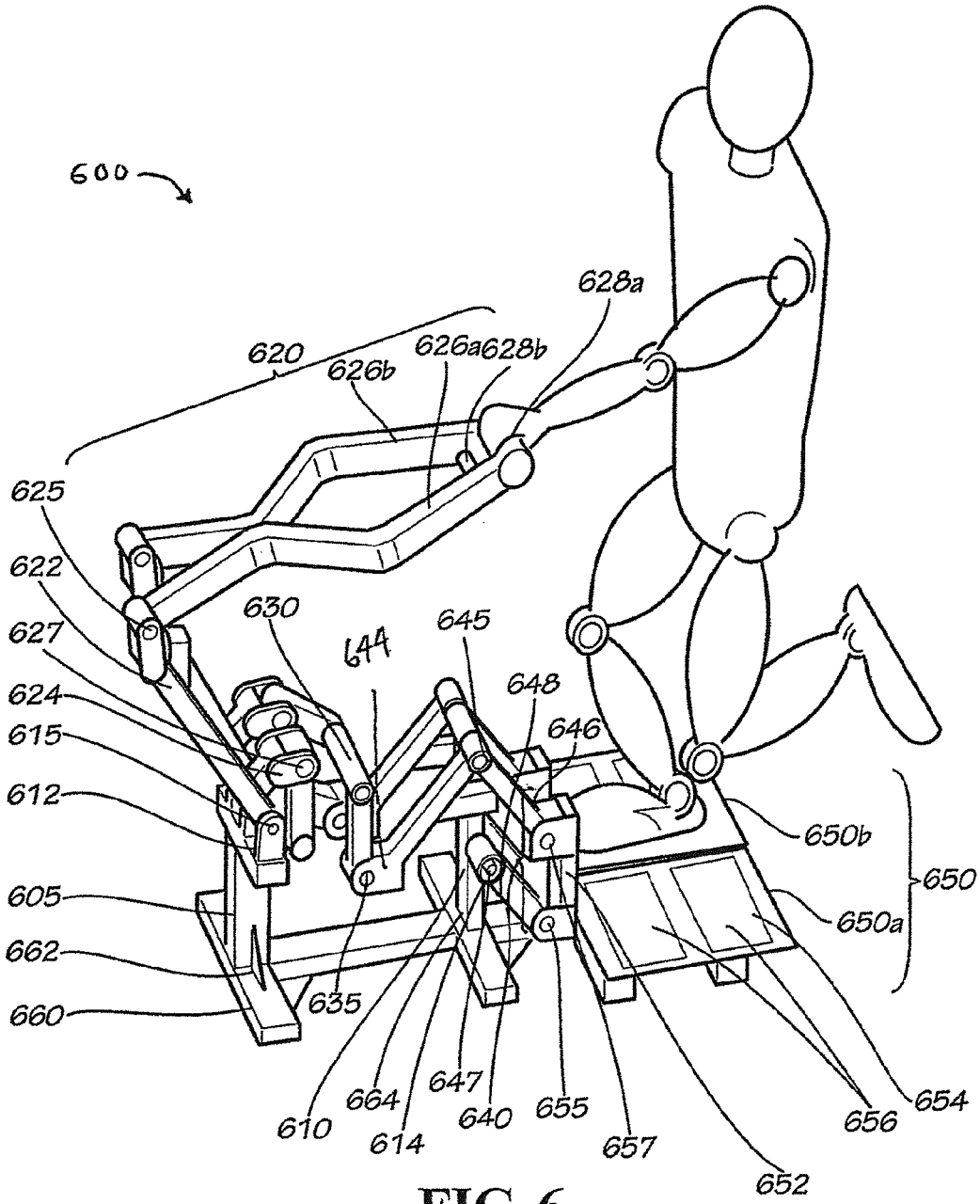
FIG. 6 illustrates a Squat Row device according to one or more embodiments of the present invention.

Next referring to FIG. 6, a Squat Row device 600 is illustrated according to one or more embodiments of the present invention.

According to one or more embodiments, Squat Row device 600 comprises a first post 605 and a second post 610, an arm assembly 620, a lift tube 630, a set of beams 640, a platform 650 and a base 660. The device 600 illustrated and described herein comprises a bilateral implementation of the Squat Row device, however, as with the Squat Press devices 100-400, different embodiments may be implemented by a simple combination of one or more elements of the device 600.

According to one or more embodiments, the posts 605 and 610 provide the supporting structure for the bilateral Squat Row device 600. In one embodiment, the first post 605 is located at or near the furthest point away from the user at a connection point 612 on the base 660 and affixed therein. In some embodiments, the base and post are welded together, while in other embodiments, these elements may be removably connected with different locks in place to provide for a secure removable connection. The second post 610 is placed further along the base 660 at a mid point 664. In some embodiments, the base and post are welded together, while in other embodiments, these elements may be removably connected with different locks in place to provide for a secure removable connection. In one embodiment, the post 605 comprises connector portion 612 for connection to the arm assembly 620 and the base 610 comprises a connection portion 614 for connecting to the beams 640. The first connector portion 612 connects to connector portion 622 of the arm assembly at connection point 615. The second connector portion 614 extending from the second post 610 provide connection to the set of beams 640. In several embodiments, the set of beams 640 comprise an upper beam set 646 and a lower beam set 648. In one embodiment, the post 610 is joined with the set of beams 640, at connection points 645 connecting to the upper beam set 646, and at connection point 647 connecting to the lower beam set 648.

The arm assembly 620 comprises a left lever 626*a* and right lever 626*b*. In some embodiments, each of the left lever 626*a* and right lever 626*b* comprises a handle 628*a* and 628*b* respectively at their end farthest from the post 605. In one or more embodiments, the handles 628*a* and 628*b* and/or the arm assembly 626*a* and 626*b* may comprise one or more of handle grips, shoulder pads, and other similar elements. In one embodiment, the user of the Squat Row device 600 drives the device by grabbing one or both the handles 628*a* and 628*b* and moving the arm assembly 620 forward towards the user, i.e. away from the post 605. In one embodiment the arm assembly levers 626*a* and 626*b* are pivotably connected to the connector portions 622 at a connection point 624. In one or more embodiments, a second connector portion 624, extending from the connector portion provides a connection between the arm assembly 620, and the lift tubes 630 at the connection points 627.

The lift tube 630 provides a pivotable connection between the arm assembly 620 and the beams 640 and through the beams to the platform 650. In one embodiment, the lift tube 630 provides the means for driving the bilateral Squat Row device 600 by transferring the movement of the arm assembly 620 by the user to one or more of the beams 640 to cause the upward movement of one or more elements of the platform 650 and thus the user, to provide the resistance necessary for achieving the strength training objectives of the Squat Row.

According to one or more embodiments, the lift tube comprises two tubes 630*a* and 630*b*. For each of the lift tubes 630*a* and 630*b*, an upper portion of the lift tube is pivotably connected with the arm assembly at a connection point 625 as stated above. In one or more embodiments, the other end of each of the lift tubes 630 connects to a connector portion 644 extending from the upper beams 646 at a connection point 645. Through the connection to the arm assembly 620 and the upper beam set 646, the lift tubes 630*a* and 630*b* translate the movement of one or both of the levers 626*a* and 626*b* of the arm assembly 620 to cause one or both sets of the beams 640 to move such that the platform 650 or a portion thereof is displaced upward, thus implementing a resistance through the body weight of the user. According to the illustrated embodiment, the lift tube 630*a* connects the left lever 626*a* of the arm assembly 620 to the right upper beam 646*b* which in turn connects to the right platform 650*b*. Similarly the lift tube 630*b* connects the right lever 626*b* of the arm assembly 620 to the left upper beam 646*a* which in turn connects to the left platform 650*a*.

The set of beams 640 comprise an upper beam set 646 and lower beam set 648. In one or more embodiments, the upper beam set 646 and lower beam set 648 are placed such that they remain parallel to one another through the range of motion of the device 600. In one embodiment, this is achieved through equal distance between connection points 645 and 647 and connection points 655 and 657. In some embodiments, the beams 640 are placed such that they ensure the upward movement of the platform 650 in an upright position without allowing the platform 650 to tilt. In an alternative embodiment, a certain tilt angle may be desirable and may be achieved by a different placement of the beams 640 and/or one or more of the connector portions or connection points 635, 645, 647, 652, 655 and 657 In one or more additional or alternative embodiments, other connection points, connector portions or elements of the exercise device may also additionally or alternatively be modified to achieve the desired tilt or modified movement of the platform. The beams 640 are connected to the platform 650 through the ends of the beams furthest from the post 610 and connector portion 652 of the platform 650 through connection points 655*a* and 657 each connecting one of the upper beam set 646 and lower beam set 648 to the connector portion 652. The placement of the beams including the length of the beams 640, the distance between the upper beams 646 and lower beams 648 and the distance between connection points 645 and 647 and connection points 655 and 657 are calculated to achieve one or more of a straight movement of the platform parallel to the base 660, a tilt angle in the platform with respect to the base, a certain amount of resistance with respect to the movement, and a range of movement of the platform 650 in relation to the movement of the arm assembly.

In one or more embodiments, the platform 650 comprises a left platform 650*a* and a right platform 650*b*, each connecting to the beams 640 through the connectors 652*a* and 652*b* respectively. The left platform 650*a* receives the left foot of the user and the right platform 650*b* receives the right foot of the user thus providing a standing position for the user. In one or more embodiments the platform 650 is designed having one or more standing pads 656. In one embodiment, the platforms 650*a* and 650*b* each comprises a flat plate 654. In some embodiments, additionally or alternatively, the platforms 650*a* and 650*b* further comprise an incline plate for receiving the user's feet to provide for a modified exercise.

The base 660 provides a standing support structure for the exercise device 600. In one or more embodiments, the base 660 is connected to the rest of the device by its connection to the posts 605 and 610. In one embodiment, the post and base are joined by being welded to one another to provide stability. In another embodiment, the base and post might be removably connected to achieve mobility.

It will be apparent that in an alternative embodiment by combining the arm assembly 620*a* and 620*b*, the lift tube 630*a* and 630*b* and the platform 650*a* and 650*b* into singular elements 620, 630 and 650 similar to the Device 100, a modified device may be achieved.

In one or more embodiments, the device 600 is designed such that it is fit for both inside and outside use. In one or more embodiments for example the device is built to be robust to withstand outside conditions such as rain, sunshine, wind or other external factors. In other embodiments, the device may comprise wheels and/or other means to allow for mobility of the device.

In one embodiment, to use device 600, the user stands on either one or both the plates 654*a* and 654*b* of the platform 650, and engages one or both of the handles 628*a* and 628*b*. In one or more embodiments, the user starts at a starting squat position grabbing the handles 628*a* and 628*b* with the arms extended outward and away from the body. Upon the users upward movement, the user pulls the lever forward toward the body causing the platform to move in an upward arc paths around the connection points at the frame comprising the posts 605 and 610 and base 660 until the levers reach a position approximate to the users chest with the user's arms fully bent and the user is at a standing position. The modified exercise occurs when the user engages one leg in the squat, and simultaneously engages the opposite-side arm for the Row. For example, the device would allow the user to stand on the right leg on plate 654*b*, and while grasping the left handle 628*a*, push upward with the right leg while pulling the lever forward with the left arm. The device 600 is connected in a way that allows this opposite-side movement, and can switch from one side to the other. It should be apparent that the previously described two handed Squat Row movement is also achievable with both legs and both arms. Regardless of whether the user is performing a one handed Squat Row or a two handed Squat Row, when the user moves the handles upward in performing a squat, the connections engage the plate which also begins to move upward. The range of motion of the Squat Row allows the user to perform a squat, and then continue forward and upward with the handles performing a row. In one or more embodiments, based on the mechanical connection points and the device's range of motion, as the user increases the range of motion, the plates continues to rise and the resistance felt at the handles increases due to the mechanical leverage. In some embodiments, this provides a progressive resistance until the user lowers the handles towards the start position. In one or more embodiments, while performing the exercise the user will be facing towards the post. In one or more embodiments, the distance traveled by the platform is a fraction of the distance traveled by the arm assembly.

In some embodiments, additional weights may be added to the device to further increase the resistance. For example, in one embodiment pegs may be implemented for adding free weights to increase overall resistance. In other embodiments, resistance may be varied by implementing a rack/pin system or pin system for adjusting lever position and thus the resistance and handle positions.

In an alternative embodiment, a similar device to those described above with respect to FIGS. 1-6 may be provided for performing a Tricep Press using the weight of the body of a user as the resistance. In some embodiments, the Tricep Press is performed as a standalone exercise. However, it should be noted that the exercise may also be combined with a lower body exercise such as a squat.

Figure 7:
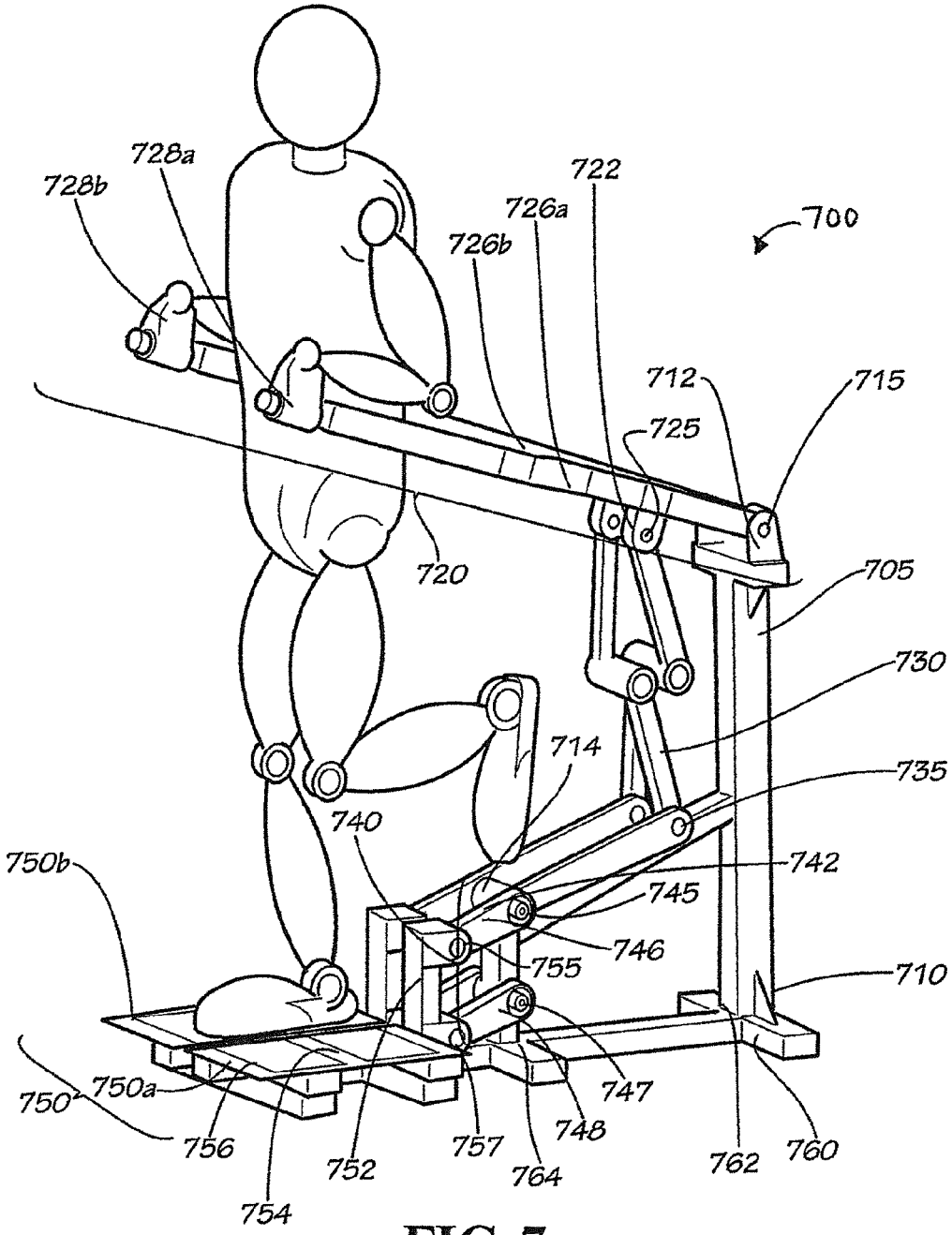
FIG. 7 illustrates a Tricep Press device according to several embodiments of the present invention.

Referring to FIG. 7, a Tricep Press device 700 is illustrated according to several embodiments of the present invention.

According to one or more embodiments, Tricep Press device 700 comprises a post 710, an arm assembly 720, a lift tube 730, a set of beams 740, a platform 750 and a base 760. The device 700 illustrated and described herein comprises a bilateral implementation of the Tricep Press device, however, as with the Squat Press devices 100-300, different embodiments may be implemented by a simple combination one or more elements of the device 700.

According to one or more embodiments, the post 710 provides the supporting structure for the bilateral Tricep Press device 700. In some embodiments, the post 710 comprises a first post 705 and a second post 710. In one embodiment, the first post 705 is located at or near the furthest point away from the user at a connection point 762 on the base 760 and affixed therein. In some embodiments, the base and post are welded together, while in other embodiments, these elements may be removably connected with different locks in place to provide for a secure removable connection. The second post 710 is placed further along the base 760 at a mid point 764. In some embodiments, the base and post are welded together, while in other embodiments, these elements may be removably connected with different locks in place to provide for a secure removable connection.

In one embodiment, the post 705 comprises connector portion 712 for connection to the arm assembly 720 and the base 710 comprises a second set of connection point 714 for connecting to the beams 740. The first set of connector portions 712 of the post 705 connects to the lever 726 of the arm assembly at connection points 715. The second connector portion 714 extending from the second post 710 provides connection to the set of beams 740. In several embodiments, the set of beams 740 comprise an upper beam set 746 and a lower beam set 748. In one embodiment, the post 710 is pivotably connected with the set of beams 740, at connection point 745 connecting to the upper beam set 746, and at connection point 747 connecting to the lower beam set 748.

The arm assembly 720 comprises a left lever 726*a* and right lever 726*b*. In some embodiments, each of the left lever 726*a* and right lever 726*b* comprises a handle 728*a* and 728*b* respectively at their end farthest from the post 705. In one or more embodiments, the handles 728*a* and 728*b* and/or the arm assembly 726*a* and 726*b* may comprise one or more of handle grips, shoulder pads, and other similar elements. In one embodiment, the user of the Tricep Press device 700 drives the device by grabbing one or both the handles 728*a* and 728*b* and moving the arm assembly 720 upward. In one or more embodiments, a connector portion 722, extending from the lever 726, provides a connection between the arm assembly 720, and the lift tube 730 at the connection point 725.

The lift tube 730 provides a pivotable connection between the arm assembly 720 and the beams 740 and through the beams to the platform 750. In one embodiment, the lift tubes 730 provide the means for driving the bilateral Tricep Press device 700 by transferring the movement of the min assembly 720 by the user to the beams 740 to cause the upward movement of one or more elements of the platform 750 and thus the user, to provide the resistance necessary for achieving the strength training objectives of the Tricep Press.

According to one or more embodiments, the lift tube comprises two tubes 730*a* and 730*b*. For each of the lift tubes 730*a* and 730*b*, the upper end of the lift tube is pivotably connected with the arm assembly at a connection point 725 as stated above. In one or more embodiments, the other end of each of the lift tube 730 connects to the upper beams 746 at a connection point 755. In one or more embodiments, through the connection to the arm assembly 720 and the upper beam set 746, the lift tubes 730*a* and 730*b* translate the movement of one or both of the levers 726*a* and 726*b* of the arm assembly 720 to cause one or both sets of the beams 740 to move such that the platform 750 or a portion thereof is displaced upward, thus implementing a resistance through the body weight of the user. According to the illustrated embodiment, the lift tube 730*a* connects the left lever 726*a* of the arm assembly 720 to the right upper beam 746*b* which in turn connects to the right platform 750*b*. Similarly the lift tube 730*b* connects the right lever 726*b* of the arm assembly 720 to the left upper beam 746*a* which in turn connects to the left platform 750*a*.

The set of beams 740 comprise an upper beam set 746 and lower beam set 748. In one or more embodiments, the upper beam set 746 and lower beam set 748 are placed such that they remain parallel to one another through the range of motion of the device 700. In one embodiment, this is achieved through equal distance between connection points 745 and 747 and connection points 755 and 757. In some embodiments, the beams 740 are placed such that they ensure the upward movement of the platform 750 in an upright position without allowing the platform 750 to tilt. In an alternative embodiment, a certain tilt angle may be desirable and may be achieved by a different placement of the beams 740 and/or one or more of the connector portions or connection points 735, 742, 745, 747, 752, 755 and 757 In one or more additional or alternative embodiments, other connection points, connector portions or elements of the exercise device may also additionally or alternatively be modified to achieve the desired tilt or modified movement of the platform. The beams 740 are connected to the platform 750 through the ends of the beams furthest from the post 710 and connector portion 752 of the platform 750 through connection points 755 and 757 each connecting one of the upper beam set 746 and lower beam set 748 to the connector portion 752. The placement of the beams including the length of the beams 740, the distance between the upper beams 746 and lower beams 748 and the distance between connection points 745 and 747 and connection points 755 and 757 are calculated to achieve one or more of a straight movement of the platform parallel to the base 760, a tilt angle in the platform with respect to the base, a certain amount of resistance with respect to the movement, and a range of movement of the platform 750 in relation to the movement of the arm assembly.

In one or more embodiments, the platform 750 comprises a left platform 750*a* and a right platform 750*b*, each connecting to the beams 740 through the connectors 752*a* and 752*b* respectively. The left platform 750*a* receives the left foot of the user and the right platform 750*b* receives the right foot of the user thus providing a standing position for the user. In one or more embodiments the platform 750 is designed having one or more standing pads 756. In one embodiment, the platforms 750*a* and 750*b* each comprises a flat plate 754*a* and 754*b* as shown. In some embodiments, additionally or alternatively, the platforms 750*a* and 750*b* further comprise an incline plate for receiving the user's feet to provide for a modified exercise.

The base 760 provides a standing support structure for the exercise device 700. In one or more embodiments, the base 760 is connected to the rest of the device by its connection to the posts 705 and 710. In one embodiment, the post and base are joined by being welded to one another to provide stability. In another embodiment, the base and post might be removably connected to achieve mobility.

It will be apparent that in an alternative embodiment by combining the arm assembly 720*a* and 720*b*, the lift tube 730*a* and 730*b* and the platform 750*a* and 750*b* into singular elements 720, 730 and 750 similar to the device 100-300, a modified device may be achieved.

In one or more embodiments, the device 700 is designed such that it is fit for both inside and outside use. In one or more embodiments for example the device is built to be robust to withstand outside conditions such as rain, sunshine, wind or other external factors. In other embodiments, the device may comprise wheels and/or other means to allow for mobility of the device.

In one embodiment, to use device 700, the user stands on either one or both the plates 754*a* and 754*b* of the platform 750, and engages one or both of the handles 728*a* and 728*b*. In one or more embodiments, the user starts at a standing position grabbing the handles 728*a* and 728*b* with the arms bent. The user then begins the Tricep Press movement by pushing one or both the levers downward and away from the chest while maintaining a proximately straight torso position, causing the levers and platform to move in a downward arc path around the connection points at the frame comprising the posts 705 and 710 and base 760 until the levers reach a position, with the user's arms fully straightened. The modified exercise occurs when the user lifts one leg off of the platform and thus is standing on one leg. In one embodiment the user may engage both levers or may only engage the opposite-side arm for the Tricep Press. For example, the device would allow the user to stand on the right leg on plate 754*b*, and while grasping the left handle 728*a* or both handles 728*a* and 728*b*, push downward on the handles bending the left arm or both arms to bring the levers downward just below the waist. The device 700 is connected in a way that allows this opposite-side movement, and can switch from one side to the other. It should be apparent that the previously described variation of the Tricep Press is achievable with one or both legs and one or both arms. Regardless of whether the user is performing a one handed Tricep Press or a two handed Tricep Press, when the user moves the handles downward, the connections engage the plate which also begins to move upward. The range of motion of the Tricep Press allows the user to continue downward with the handles. In one or more embodiments, based on the mechanical connection points and the device's range of motion, as the user increases the range of motion, the plates continues to rise and the resistance felt at the handles increases due to the mechanical leverage. In some embodiments, this provides a progressive resistance until the user raises the handles towards the start position. In one or more embodiments, while performing the exercise the user will be facing away from the post. In one or more embodiments, the distance traveled by the platform is a fraction of the distance traveled by the arm assembly.

In some embodiments, additional weights may be added to the device to further increase the resistance. For example, in one embodiment pegs may be implemented for adding free weights to increase overall resistance. In other embodiments, resistance may be varied by implementing a rack/pin system or pin system for adjusting lever position and thus the resistance and handle positions.

In some embodiments, certain characteristics of the elements of the devices 100-700 are implemented to achieve a desirable resistive force as a result of the movement of the device, and further to achieve a desirable movement of the lever and platforms. For example, in one or more embodiments of the above described devices 100-700 the length, connection points and shape or design of one or more of elements may be varied to vary the resistance or range of motion of the device, and or one or more elements of the device. It should be well understood that the exact characteristics of the elements is dependent upon the desirable resistance and range of motion and can be achieved through a formula taking into account the length and shape of one or more of the elements, and the position of one or more of the elements and connection points in relation to one another.

In addition, in several embodiments the design and mechanical position of one or more of the elements of the devices 100-700 may be varied to allow for different size users and or a modified exercise. For example, this may be achieved, according to one embodiment, by providing means for adjusting the grip positions, connection points, etc. Furthermore, the described elements of one or more embodiments of the invention may be combined in any suitable manner. In one or more embodiments, the above described embodiments may be implemented without one or more of the specific details, or with other methods, components, materials, and so forth. Furthermore, in one or more embodiments, well-known structures, materials, or operations not shown or described may be added to the above embodiments to provide for modified embodiments.

The above devices 100-700 are further fit for outside use due to the ability of the device to provide progressive resistance without the need for electrical components by employing the body weight of the user as means of resistance.

While the invention herein disclosed has been described by means of specific embodiments, examples and applications thereof, numerous modifications and variations could be made thereto by those skilled in the art without departing from the scope of the invention set forth in the claims.

The invention claimed is:

1. A method comprising:

providing a post;

providing an arm assembly and pivotably connecting the post and the arm assembly at one or more connection points;

providing a set of beams comprising an upper beam set and a lower beam set, wherein the upper beam set and the lower beam set each comprise one or more beams;

pivotably connecting the set of beams to the post, wherein the post is connected to the upper beam set and the lower beam set such that the lower beam set and the upper beam set are positioned at a first distance apart from one another at their connection point with the post;

pivotably connecting a platform to the set of beams, wherein the platform is connected to the upper beam set and the lower beam set such that the lower beam set and the upper beam set are positioned at a second distance apart from one another at their connection point with the platform; and providing a lift tube having a length and pivotably connecting the lift tube to the upper beam set at one or more connection points and the arm assembly at one or more connection points.

2. The method of claim 1, wherein providing the arm assembly comprises providing a left arm and right arm;

providing the set of beams comprises providing a left beam set comprising a left upper beam set and left lower beam set and a right beam set comprising a right upper beam set and a right lower beam set;

pivotably connecting the platform to the set of beams comprises providing a left platform and pivotably connecting the left platform to the left beam set and providing a right platform and pivotably connecting the right platform to the right beam set; and providing the lift tube comprises providing a left tube and pivotably connecting the left tube to the left arm and the right beam set at one or more connection points and further providing a right tube and pivotably connecting the right tube to the right arm and the left beam set;

wherein providing for bilateral movement.

* * * * *